US007118243B2

(12) United States Patent
McCavit et al.

(10) Patent No.: US 7,118,243 B2
(45) Date of Patent: Oct. 10, 2006

(54) WAX SHELL IMITATION CANDLE WITH IMPROVED RESISTANCE TO CRACKING

(75) Inventors: Kim I. McCavit, Saint Joseph, MI (US); Bradford B. Jensen, Saint Joseph, MI (US)

(73) Assignee: Jenesis International, Inc., Stevensville, MI (US)

( * ) Notice: Subject to any disclaimer, the term of this patent is extended or adjusted under 35 U.S.C. 154(b) by 303 days.

(21) Appl. No.: 10/801,917

(22) Filed: Mar. 16, 2004

(65) Prior Publication Data

US 2005/0207171 A1 Sep. 22, 2005

(51) Int. Cl.
*F21L 19/00* (2006.01)

(52) U.S. Cl. ..... 362/161

(58) Field of Classification Search ..... 362/128, 362/161, 162, 163, 447, 190, 288, 157; 431/289, 431/297

See application file for complete search history.

(56) References Cited

U.S. PATENT DOCUMENTS 3,761,702 A * 9/1973 Andeweg ..... 362/161
3,890,085 A * 6/1975 Andeweg ..... 431/125
5,597,300 A * 1/1997 Wohl et al. ..... 431/288
6,375,455 B1 * 4/2002 Frandsen et al. ..... 431/289
6,491,517 B1 * 12/2002 Freeman et al. ..... 431/291
6,544,303 B1 * 4/2003 Calzada ..... 44/275
6,616,308 B1 * 9/2003 Jensen et al. ..... 362/351
6,966,665 B1 * 11/2005 Limburg et al. ..... 362/96

FOREIGN PATENT DOCUMENTS

WO WO 03/016783 A1 2/2003

* cited by examiner

*Primary Examiner*—Renee Luebke
*Assistant Examiner*—Julie A Shallenberger
(74) *Attorney, Agent, or Firm*—O'Malley and Firestone

(57) ABSTRACT

An imitation candle having an exterior wax shell and an interior illumination source is structured to reduce cracking of the exterior wax shell by incorporating a bonding layer into a central cavity in the shell between the interior illumination source and the wax shell. The bonding layer terminates well spaced from terminal edges of the shell to transfer stress between the illumination source and the shell caused by differing coefficients of thermal expansion to points removed from edges of the shell to retard crack genesis.

8 Claims, 7 Drawing Sheets

WAX SHELL IMITATION CANDLE WITH IMPROVED RESISTANCE TO CRACKING

BACKGROUND OF THE INVENTION

1. Technical Field

The invention relates to wax imitation candles and more particularly to an imitation candle resistant to cracking at low temperatures.

2. Description of the Problem

Many people find candle light pleasant. The flickering of light and movement of shadows across a floor or on a nearby wall can be almost hypnotically soothing. As a result, candles have remained popular for generations since the invention of more practical electrical lighting, especially for decorative and mood setting purposes.

Consequently, numerous manufacturers have attempted to meet a demand for a candle like luminary using electrical illumination. A now popular imitation candle is taught in International Publication Number WO 03/016783 A1. This imitation candle uses an internal LED as a light source within a solid appearing body. While a classical image of a candle is of a long, thin, tapering rod, which stands upright in a candle stick and which leaves its flame exposed as it burns down, this imitation candle comes as a relatively short to circumference block or cylinder which is self supporting. Such candles commonly leave the outer wall of the candle intact as the candlewick burns down. When this happens, the candle flame is no longer directly visible when viewed from the side. This results in a diffuse, flickering glow visible through the paraffin wall of the candle, which is imitated by the external shape of the imitation candle.

While the imitation candle of WO 03/016783 appears to be a solid body to users it is in fact hollow. This provides space for the installation of batteries, the LED, LED excitation circuitry and possibly light directing internal components. In addition, the contour of the void's internal surface may be chosen for light transmission issues. While the imitation candle can readily be made in plastic, fabricating it in more realistic wax has presented particular problems.

Wax is highly susceptible to compressive and tensile stress. Waxes also tend to have high coefficients of thermal expansion. Differential heating and cooling of sections of a cast wax body introduces stress. Stress tends to be focused along sharp corners and edges of a wax body. Stress can occur during manufacturing and shipping of the wax shell imitation candles when the imitation candles are subjected to rapid cooling or great temperature extremes, respectively. The cavity adds the problem of internal edges, as well as reducing the strength of the body compared to a solid wax body. In addition, the insert on which battery, excitation circuitry and the LED are mounted will typically be constructed by plastic with the wax body being formed in part on the insert body. Wax will typically have a higher coefficient of expansion than the plastic does, which results in additional stress as temperature of the body decreases and contributes further to the problems of the inherent weakness of wax.

Wax bodies, such as candles, are formed by a process of casting. Where it is desired to incorporate a plastic module in the wax body the plastic module may be fixed in position in a mold and hot wax poured around the module, adding wax as earlier poured wax cools and shrinks, until all voids around the module are filled. Alternatively, a wax shell can be formed that produces the outer visible surfaces of the candle while leaving a space for the module. After the shell is produced a second pour is done to secure the module in position. The amount of wax in the second pour is less than in the first, with the attendant advantages of quicker cooling and faster production speeds. While true, solid wax candles have reasonable durability to withstand cold temperature induced stress, wax bodies made by either of the foregoing casting techniques have proven highly susceptible to cracking. Thin sections of the casting adjacent the module cool more rapidly than thicker sections. Leading edges of the imitation candle also cool rapidly. These sections of rapid cooling result in differential rates of contraction, which can easily result in formation of a crack to relieve stress. Once such a crack propagates into a thicker section of the body it can become a focal point for other stresses and can extend to encircle the imitation candle body.

SUMMARY OF THE INVENTION

According to the invention there is provided an imitation candle. The imitation candle has a wax shell having a central cavity defined by an interior surface. A artificial lighting module, which tends to exhibit a different thermal coefficient of expansion than the wax, is positioned in the central cavity. A bonding layer between a portion of the module and the interior surface of the wax shell retains the module in the shell. The bonding layer leaves a gap between the insert and the interior surface near any exterior edges of the wax shell. The gap is preferably filled with air.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
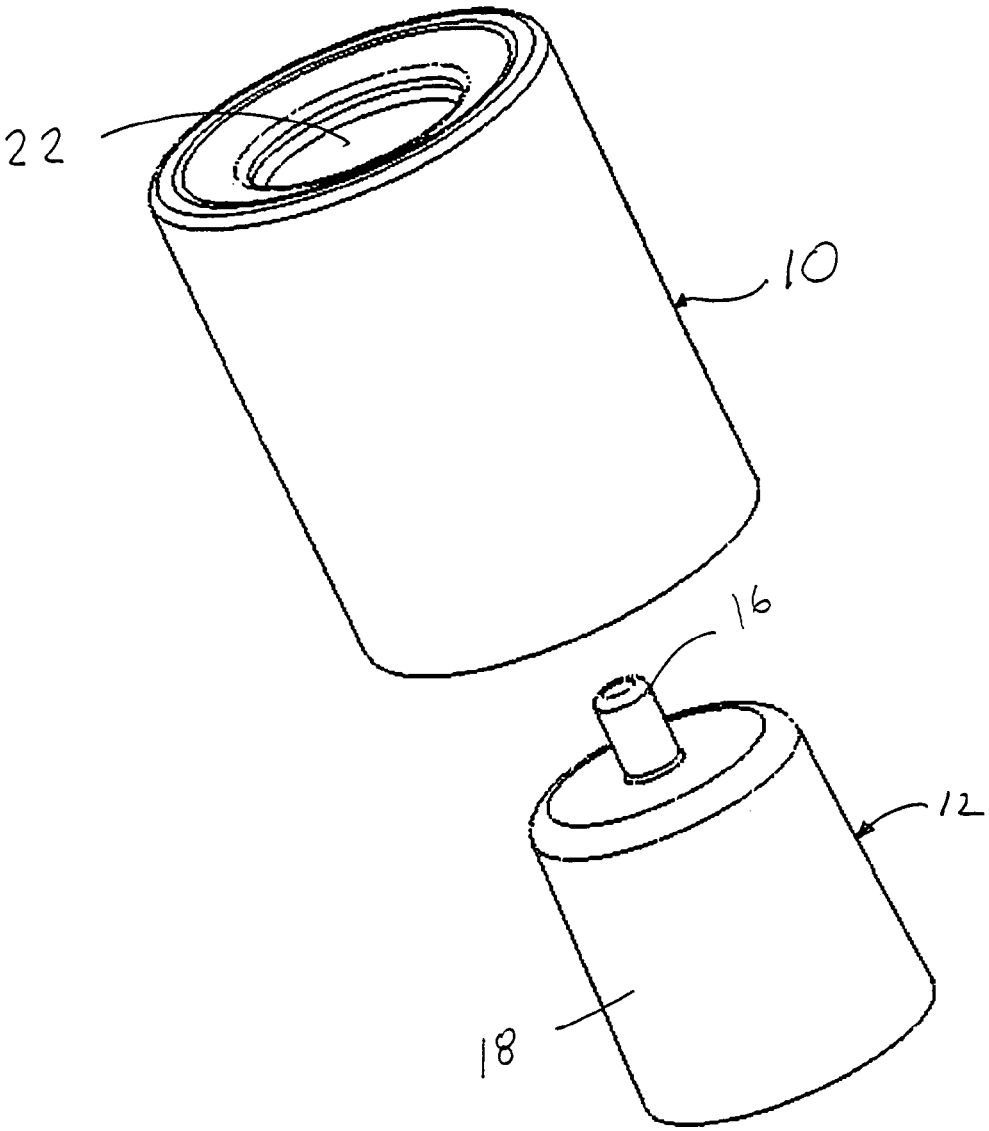
FIGS. 1 and 2 are perspective views from different angles of a wax shell and artificial illumination source for insertion thereto.
Figure 2:
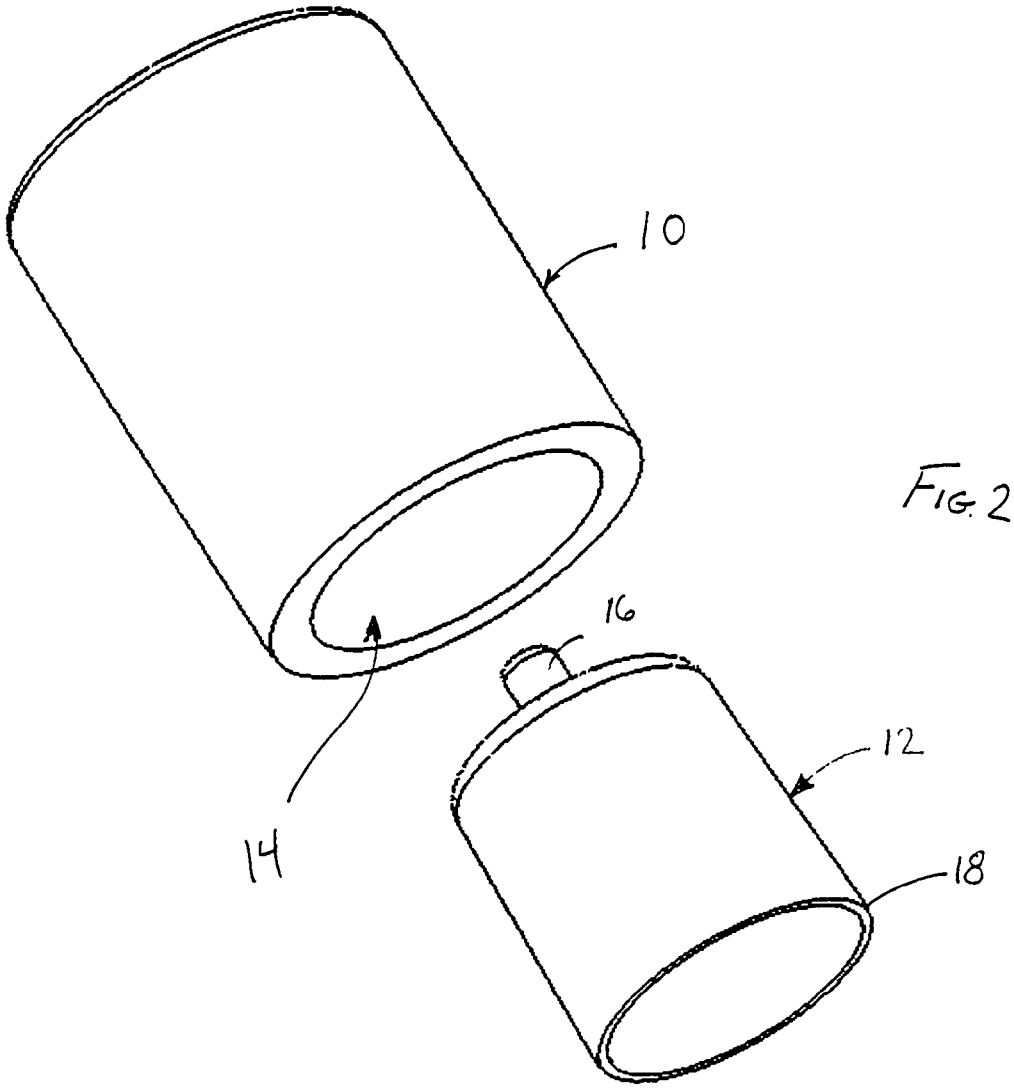

Referring now to FIGS. 1 and 2 a shell 10 and an insert or illumination module 12 which includes circuitry, batteries and a light emitting diode for insertion into the shell are shown from above and below. Shell 10 is a generally squat, cylindrical body, with dimensions common to free standing, thick walled candles. An upper surface 22 of shell 10 is depressed into the interior of the shell to simulate a previously burned candle the center of which is partially melted and consumed. Insert 12 fits into and is retained within cavity 14 defined by an interior surface 15 of shell 10. Cavity 14 is open along a bottom surface of shell 10 and is slightly oversized, as described below, to admit insert 12. Shell 10 is preferably a cast wax body. Insert 12 has an exterior casing 18 made enclosing the battery, circuitry and an LED enclosed in an upper surface 16 of the insert 12. Insert 12 is introduced to cavity 14 lead by upper surface 16. The wax material of shell 10 and the plastic material of casing 18 exhibit substantially different coefficients of thermal expansion. The present invention concerns mating of the interior surface of shell 10 and casing 18 of insert 12 to inhibit cracking of the wax of the shell.

Figure 3A:
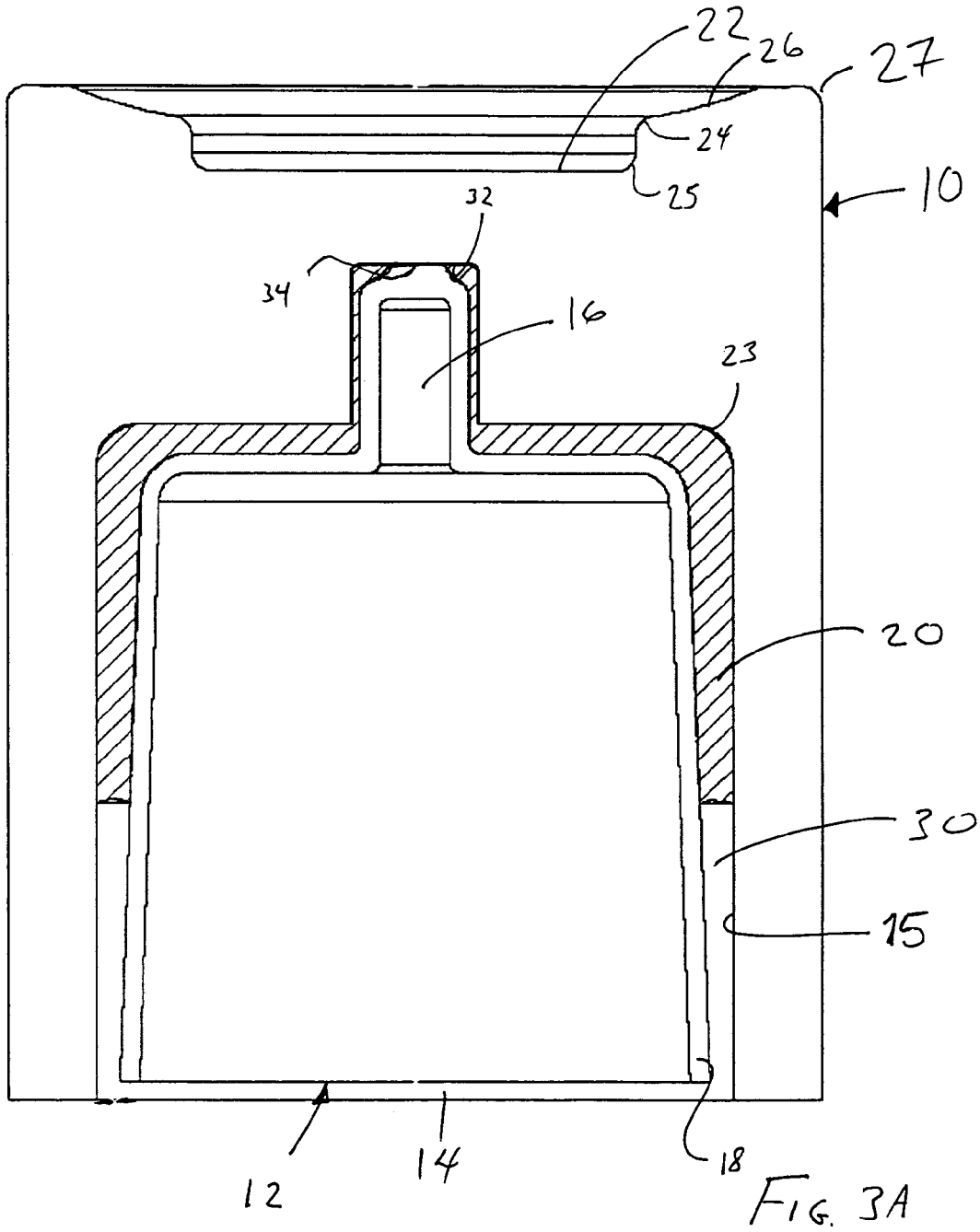
FIGS. 3A and 3B are cross sectional views of wax shell imitation candles constructed in accordance with each of two preferred embodiments of the invention.
Figure 3B:
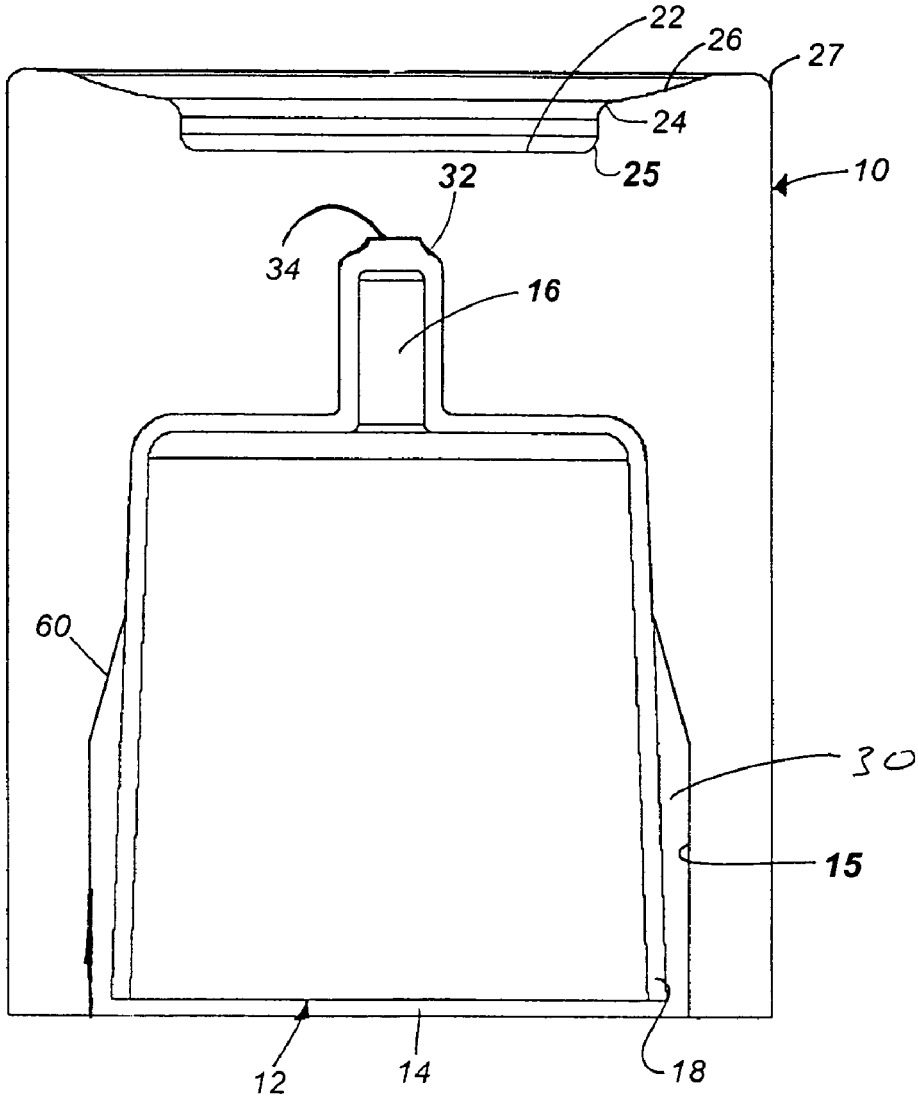
Figure 4:
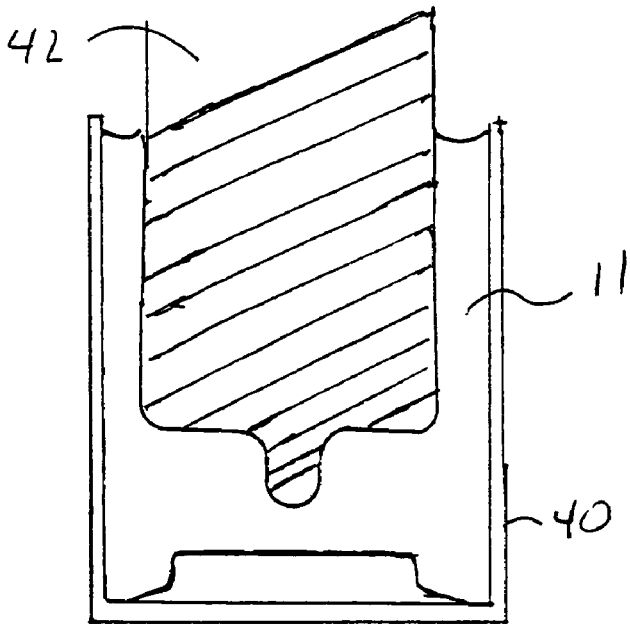
FIG. 4 depicts a first step in a process for fabricating the wax shell imitation cancle of FIG. 3.
Figure 5:
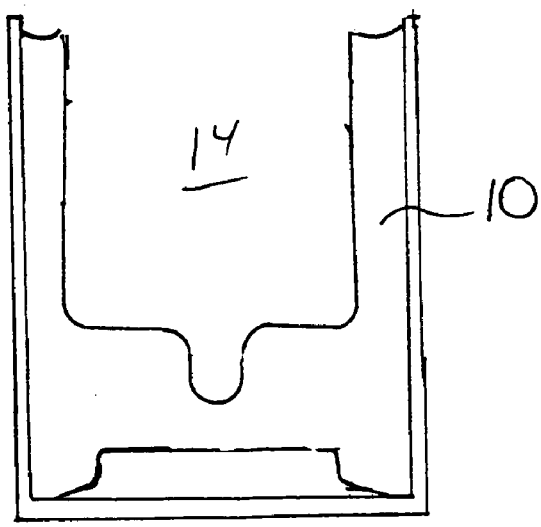
FIG. 5 depicts a subsequent process step following the step of FIG. 4.
Figure 6:
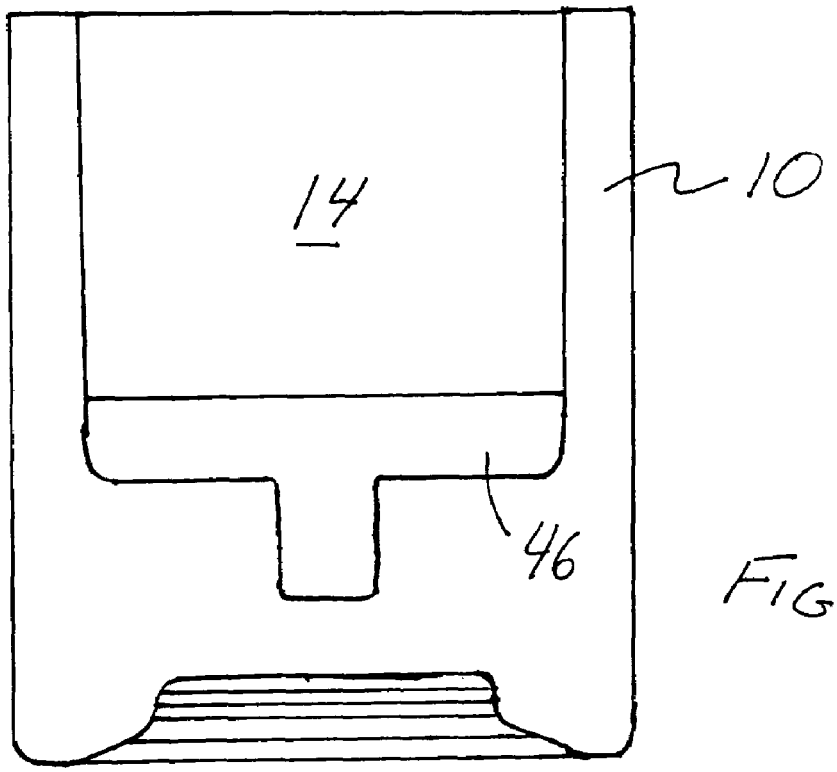
FIG. 6 depicts a subsequent process step following the step of FIG. 5.
Figure 7:
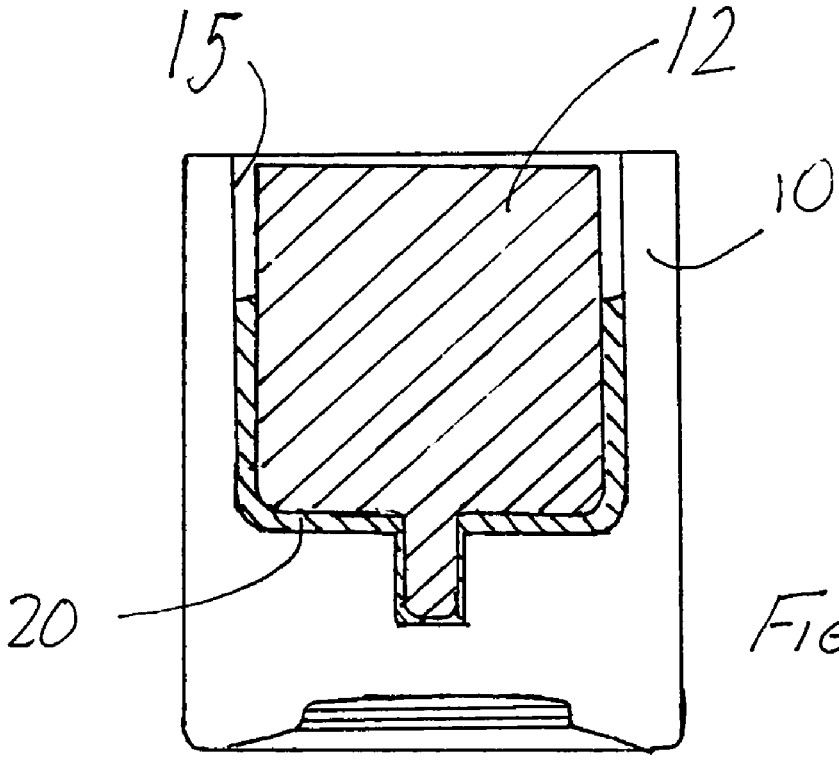
FIG. 7 depicts a subsequent process step following the step of FIG. 6.

Referring to FIGS. 3A and 3B some of the features of the invention as incorporated into each of two preferred embodiment of the invention may be seen to advantage. The central depression in upper surface 22 begins spaced inwardly from a rounded circumferential exterior edge 27 with a shallow downwardly slanted ledge 26, which terminates moving toward the vertical center axis of shell 10 in a rounded shoulder 24 where the upper surface drops to a central depression defined by a second shoulder 25. Insert 12 is illustrated fitted into cavity 14 from the bottom of shell 10. Cavity 14 is defined by an interior surface 15 which, in a fashion similar to the central depression in the upper surface 22, has rounded transitions between portions of the surface which exhibit substantial intersecting angles vis-a-vis one another. Rounded transition 23 is characteristic forming a boundary between a cylindrically shaped, vertically oriented section of interior surface 15 and a horizontally oriented disk like section at the top of cavity 14.

Insert 12 is undersized compared to the cavity 14 in which it is to be retained. Bonding between a plastic insert casing 18 is provided by bonding layer 20 which lines the upper portion of cavity 14 between casing 18 and interior surface 15. As described below, bonding layer 20 is formed by a second pouring of a small quantity of molten wax into an inverted, but already cooled and hardened shell 10. Bonding layer 20 is shaped by fitting insert 12 into cavity 14 while the second poured wax is still molten. Bonding layer 20 does not line all of interior surface 15 in the preferred embodiment, but only enough to cover casing 18 around LED 16 and about the top half of the main body of insert 12. An air gap 30 surrounds the bottom half of insert 14 spacing the insert from interior surface 15. The top 32 of illumination module 14 abuts an upper horizontal face 34 of interior surface 15, displacing molten wax and positioning the illumination module vertically. Horizontal positioning of illumination module may be achieved by careful reference to the spacing between casing 18 and interior surface 15 and by the careful, mutually parallel orientation of the elements. The bottom surface of insert 12 is slightly recessed (2.5 mm) from the surrounding bottom surface of shell 10 allowing accurate determination disposition of the insert in cavity 14.

While use of a bonding layer 20 is preferred due to the assurance of a good fit between the bonding layer and insert 12, it is possible to substitute a molded or shaped shoulder 60 which is formed as part of interior surface 15 defining cavity 14. As seen in FIG. 3B shoulder 60 is part of shell 10 and slants inwardly into cavity 14 partway into the cavity from the bottom surface of shell 10. Construction of shell 10 to incorporate such a circumferential shoulder is easily done by modification of the bit used to shape cavity 14 or form 42. It is important that a gap be left between the body of insert 12 and interior surface 15 in the lower part of cavity 14. This saves processing steps. However, the difficulty in this technique is that extremely close tolerances in dimensional matching between the insert 12 and the shell 10 are required to avoid introducing stress on introducing the insert to cavity 14. It may be possible to time the introduction to a point while the wax of shell 10 is still slightly soft.

FIGS. 4 through 7 help illustrate a process for fabricating the imitation candle of the present invention. The first step of the process is to pour molten wax 11 into a mold 40 giving the body of wax which cools to form shell 10 its exterior shape. Mold 40 should be slightly taller then the desired eventual size of shell 10 to allow trimming of the cooled body to the desired size. Cavity 14 may be formed in one of two ways. In one process, a form 42 is held in the mold 40 to leave cavity 14 upon withdrawal from the hardened shell 10. Alternatively, no form is used and the mold 40 is substantially filled with wax on the first pouring. In a preferred embodiment mold 40 is 111 mm deep allowing trimming of shell 10 to a desired height of 105 mm.

After pouring of the wax for shell 10 the wax is allowed to cool. Where no form is used the wax is allowed to cool until the wall thickness is at least 10 mm. Where a form 42 is used the wax is allowed to cool until the entire shell 10 has hardened. A water bath may be used to expedite the cooling process. If no form was used a hole is formed into the cooling body from what will be become the bottom surface of the shell to the interior, still molten wax. The mold is partially inverted to allow the molten wax to be poured out and reclaimed. Removal of the central, molten wax speeds the cooling process and relieves stress on the walls of shell 10. The shell continues cooling, again potentially placed in a water bath to quicken the process. Mold 40 is advantageously shaped to impress an upper surface central depression into shell 10. Where, however, the mold did not incorporate such a shape, a bit contoured with the cross section of the upper surface may be used to shape the upper surface after withdrawal of the shell 10 from mold 40.

The position of insert 12 is controlled by the depth of cavity 14. An inner bit may be used trim the bottom of shell 10 and to machine cavity 14 where no interior form 42 is used, or where adjustment of the shape of a cavity left by a form is required. Shell 10 should be properly fixtured during shaping with a bit to insure a uniform core depth and candle height.

With the shell 10 fully hardened and the shape of cavity 14 finalized, shell 10 is reinverted and a second pour 46 of a small quantity of molten wax is made into the top of cavity 14. By the term "small" it is meant that the amount of wax in the second pour is a small percentage of the quantity of wax in the first pour. Where the depth of cavity 14 is 86 mm, the pour will leave the upper 58 mm empty before insertion of the insert 12. The formulation of the wax may be the same for both pours. With the second pour 46 still molten, insert 12 is lowered into cavity 14 of the inverted shell 10, displacing molten wax of the second pour 46 upwardly around the insert along the interior surface 15 of the cavity to form a bonding layer 20. Insert 12 is pressed as far as possible into shell 10, until the casing around upper surface 16 hits the top surface of the interior surface 15. An air gap of about 30 mm extends upwardly from the bottom of shell 10 into cavity 14 around insert 12. This helps prevent cracking.

The invention impedes the genesis and spread of cracks in the wax shell of a two component imitation candle. The assembly method for embedding insert 12 moves the point of maximum stress to a position where the stress is more readily tolerated. This is achieved by forming a gap between the insert and thin walled sections of the wax starting from a leading edge of the wax (e.g. the bottom edges of the shell). The gap can be air, or it can be filled with substances which offer insubstantial resistance to contraction of the wax as it cools. Leaving a gap between the bottom edge of the shell moves the point of maximum stress to an area of the shell where the gap ends and the bonding layer begins. This places the point of maximum stress away from any corners or edges. Cooling of the shell is also retarded here due to the greater local thermal mass, allowing more time for internal stress relief. The invention also achieves reduced concentration of stress by maintaining a maximum degree of uniformity in wax wall thickness and eliminating sharp corners.

While the invention is shown in only two of its forms, it is not thus limited but is susceptible to various changes and modifications without departing from the spirit and scope of the invention.

What is claimed is:

1. An imitation candle comprising:

a wax shell having an interior central cavity defined by an interior surface of the wax shell;

an insert having a different thermal coefficient of expansion than the wax shell, the insert being positioned in the interior central cavity to leave a gap between the insert and the interior wall of the interior central cavity; and a wax bonding layer disposed in a portion of the gap between the insert and the interior surface of the wax shell to positionally retain the insert in the wax shell while relieving and redirecting stress stemming from differential expansion and contraction of the insert and the wax shell due to changes in temperature.

2. An imitation candle as set forth in claim 1, further comprising:

the wax bonding layer being formed from a pour of molten wax into a previously cast and hardened wax shell and placement of the insert into the molten wax to force the molten wax to spread around and conform to the insert between the insert and interior surface before hardening into the bonding layer.

3. An imitation candle as set forth in claim 2, further comprising:

such portion of the gap not filled by the wax bonding layer being filled with air.

4. An imitation candle as set forth in claim 3, wherein the interior central cavity and the gap extend into the wax shell from an open end of the wax shell.

5. An imitation candle as set forth in claim 4, further comprising:

the insert providing a source of artificial illumination.

6. An imitation candle as set forth in claim 3, further comprising:

a plurality of edges between surfaces of the shell exhibiting substantial angles of intersection being rounded.

7. A process for making an imitation candle comprising the steps of:

casting a shell from molten wax;

forming a central cavity from a bottom surface of the shell into the interior of the shell;

after hardening of the shell making a second pouring of wax into the central cavity with the shell inverted, the second casting comprising a substantially reduced quantity of wax; and inserting a module into the central cavity with the shell still inverted and the second pour of wax still molten to displace the molten wax of the second pouring to form a bonding layer between the module and the shell upon cooling of the wax, the combined volume of the module and the wax from the second pouring being substantially less than that required to fill the central cavity.

8. The process as claimed in claim 7, further comprising the step of:

leaving a wax free gap between a portion of the module and the interior surface of the central cavity.

* * * * *